US007452124B2

(12) United States Patent
Hiranuma et al.

(10) Patent No.: US 7,452,124 B2
(45) Date of Patent: Nov. 18, 2008

(54) TIMEPIECE HAVING GLASS AND GLASS-HOLDING MEMBER REMOVABLE AS A UNIT FROM CASE BAND

(75) Inventors: Haruki Hiranuma, Chiba (JP); Nobukazu Omori, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/635,472

(22) Filed: Dec. 7, 2006

(65) Prior Publication Data

US 2007/0145197 A1 Jun. 28, 2007

(30) Foreign Application Priority Data

Dec. 26, 2005 (JP) ..... 2005-372821

(51) Int. Cl.
*G04B 37/00* (2006.01)

(52) U.S. Cl. ..... 368/294; 368/309

(58) Field of Classification Search ..... 368/294–296, 368/291, 286, 309–310; 968/368, 373
See application file for complete search history.

(56) References Cited

U.S. PATENT DOCUMENTS 3,979,902 A * 9/1976 Miyasaka et al. ..... 368/294
4,496,248 A * 1/1985 Waki et al. ..... 368/291

* cited by examiner

*Primary Examiner*—Renee S Luebke
(74) *Attorney, Agent, or Firm*—Adams & Wilks

(57) ABSTRACT

A timepiece has an annular case band having a front side end part that protrudes radially inwardly toward the inside of a case band and defines a front opening of the case band. A case back is detachably attached to a back side end part of the case band. An annular edge member seats on a front surface of the front side end part and has a tubular part removably inserted into the front opening of the case and, the tubular part having an annular attaching groove that opens to an outer periphery of the tubular part, and a glass is fixed to the edge member. An elastically deformable open-ended snap ring is detachably attached to the attaching groove in an elastically deformed state, and the snap ring abuts a back surface of the front side end part of the case band so that the front side end part is held between the edge member and the snap ring. The snap ring is detachable from the attaching groove when elastically expanded by a tool inserted from the back side of the case band to enable removal of the edge member and glass as a unit from the case band for repair or replacement.

17 Claims, 8 Drawing Sheets

FIG. 4
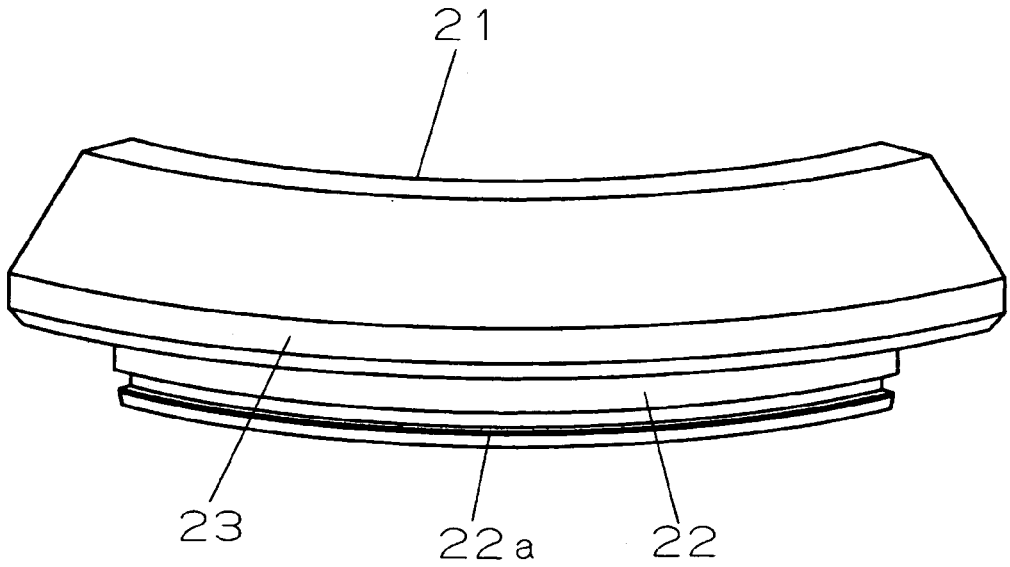
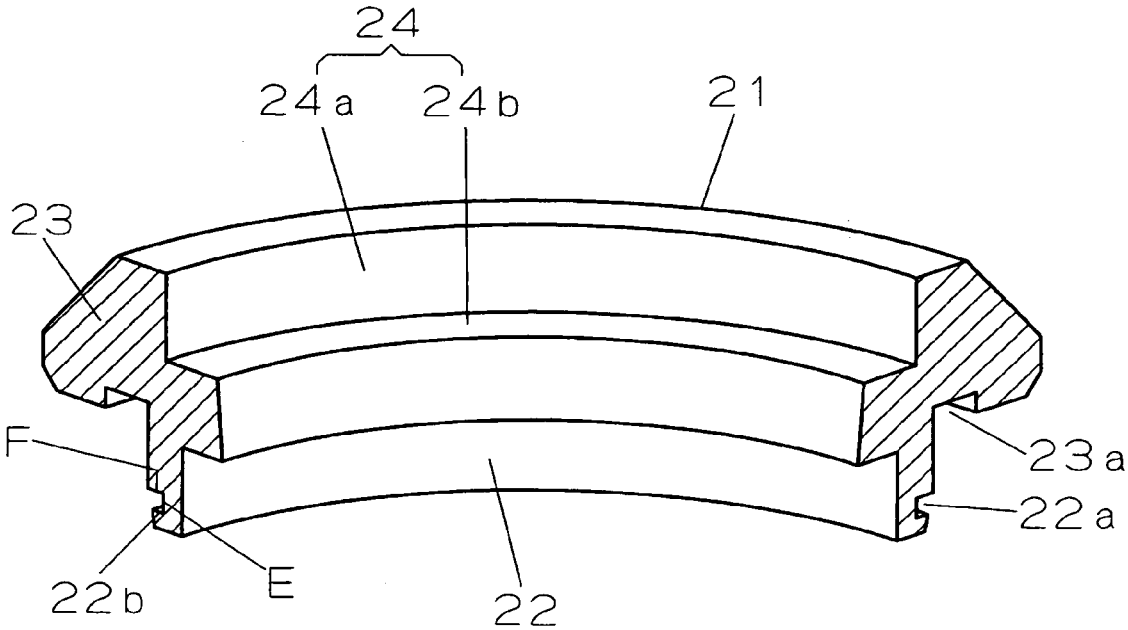
FIG. 5

TIMEPIECE HAVING GLASS AND GLASS-HOLDING MEMBER REMOVABLE AS A UNIT FROM CASE BAND

BACKGROUND OF THE INVENTION

1. Field of the Invention

The present invention relates to a timepiece such as a portable watch like, e.g. a wristwatch and a pocket watch, a desk clock and a wall-mounted clock.

2. Description of the Prior Art

Hitherto, among wristwatches possessing a case back, there is known a wristwatch in which an annular protrusion part is formed in an inner periphery of a front side end part of a case band in which a dial is accommodated, to the inner periphery of this annular protrusion part, a glass covering the dial is fitted and fixed and a tubular member of an edge member functioning also as a bezel is fitted, and a caulking part integral with this tubular part has been caulked to a back face of the annular protrusion part (for example, refer to JP-UM-B-5-37273 Gazette).

In the wristwatch in which the edge member has been caulked to the case band as mentioned above, since the fact that a caulked part having been deformed is caulked again after having been returned to a state before being caulked extremely decreases a mechanical strength of the caulked part, it is impossible to detach the edge member from the case band. For this reason, in a case where the edge member has been impaired, a user of the wristwatch is obliged to exchange not only the edge member to which the glass has been fixed but also the case band to which this edge member has been caulked.

Further, in a wristwatch in which a waterproofness has been intended by nipping a seal packing between the case band and the edge member, there is considered the fact that a performance of the seal packing decreases during a long period guarantee term of the wristwatch and thereafter. Also in a case where, in order to cope with this, it is attempted to exchange the seal packing, since it is possible to detach the edge member from the case band, it is obliged to exchange not only the edge member but also the case band to which this edge member has been caulked.

SUMMARY OF THE INVENTION

An object of the present invention is to provide a timepiece in which it has been made possible to exchange the edge member to which the glass has been fixed, without also exchanging the case band.

The present invention comprises an annular case band which has a front side end part forming a fitting hole, and in which the end part has an edge receiving face around the fitting hole and an engaging back face continuous so as to bulge around the fitting hold, and a case back detachably attached to a back side end part of the case band. An annular edge member has a tubular part capable of being inserted into and disengaged from the fitting hole and a cover part overlapped with the edge receiving face, and in which in the tubular part is an annular attaching groove opening to an outer periphery of the tubular part. A glass is fitted and fixed to an annular step part formed in the edge member, and a snap ring formed in a C-shaped form from elastic material is detachably attached to the attaching groove. The front side end part of the case band is nipped between the snap ring and the cover part while catching to the engaging back face, and the snap ring is attached/detached under a state that the case back has been detached.

In the present invention, the edge receiving face may be provided continuously so as to bulge from a front side open end of the fitting hole to its periphery, or may be provided by forming a step between it and the front side open end such that the front side open end and the edge receiving face exist in different height positions about a thickness direction of the case band. Further, the edge receiving face and a contact face, of the cover part, contacting with the former is not limited to a plane, along a direction perpendicularly intersecting with a thickness direction of the case band, and may be a slant face along a direction slantingly intersecting with the thickness direction of the case band or a curved face curving along the direction slantingly intersecting with the thickness direction of the case band.

In the present invention, the outer periphery of the tubular part and the fitting hole into which this tubular part is inserted may be a circular shape or a polygonal shape. In the present invention, a fixation of the glass to the annular step part of the edge member may be fixed by using an adhesive, or pressure-inserting the glass to the annular step part with a seal part having an elasticity being nipped between it and the annular step part.

In the present invention, the snap ring of a C-shaped form or the like can be suitably formed by a metal which can elastically deform, and the like. Together with this, as to a sectional shape of the snap ring, a quadrangle is desirable in a viewpoint of more largely ensuring a catching margin to the engaging back face, and more desirably it suffices if it is made a long quadrangle whose thickness is thin. However, a sectional shape of the snap ring may be a circular shape. Further, in the present invention, a sectional shape of the attaching groove formed in the tubular part is not limited to correspond to the sectional shape of the snap ring, and it can be made a V-shaped form in section irrespective of the sectional shape of the snap ring. In the latter case, it is possible to prevent an unsteadiness of the snap ring, which results from a dimensional dispersion of the annular attaching groove and a dispersion in a sectional dimension of the snap ring. For this reason, it is preferable in a point that an attachment of the edge member to the case band is more easily stabilized by strengthening a nipping to the front side end part by the snap ring and the cover part.

In the present invention, a state that the cover part of the edge member has been overlapped with the edge receiving face of the case band by the fact that the tubular part of the edge member to which the glass has been fixed is inserted into the fitting hole of the case band, is held by the snap ring having been accommodated inside the case band and disposed over the engaging back face of the front side end part and the attaching groove of the tubular part, and this snap ring can be attached/detached under a state that the case back has been opened. For this reason, in a case where the edge member has been impaired or the like, the edge member can be attached to and detached from the case band by attaching/detaching the snap ring. Accordingly, the edge member to which the glass has been fixed can be exchanged without accompanying the case band.

In a preferred mode of the present invention, there is possessed an annular seal packing having been nipped between the edge receiving face and the cover part under a compressed state. Here, the seal packing may be provided by annularly forming a holding groove in either of the edge receiving face and the cover part and fitting it to this holding groove, or also can be provided without forming such a holding groove.

In this preferred mode, as already mentioned, since an incorporation and a separation of the edge member with respect to the case band can be performed by the attachment/ detachment of the snap ring, in a case where a performance of the seal packing bearing a waterproofness/dustproofness between the edge receiving face and the cover part has decreased, it is possible to exchange this packing without accompanying at least the case band between the case band and the edge member.

Additionally, in a preferred mode of the present invention, at least one part of the snap ring is made an operating part when the snap ring is detached from the attaching groove by protruding it from the outer periphery of the tubular part and, between the operating part and the tubular part, there is formed a wedge-like tool inserting gap when it is seen from the case back side.

In this preferred mode, since there is previously formed the tool inserting gap into which a tool for detaching the snap ring is inserted under a state that the snap ring has been attached to the tubular part, it is possible, when the edge member is detached form the case band, to detach the snap ring from the tubular part by opening this snap ring while resisting against its elasticity after easily inserting a tip of the tool into the tool inserting gap.

Further, in a preferred mode of the present invention, a tool inserting small hole is provided in a site having been separated from the tubular part in at least one end part of the snap ring, and thereby the one end part is made an operating part when the snap ring is detached from the attaching groove.

In this preferred mode, since there is located, outside the tubular part, the tool inserting small hole into which the tool for detaching the snap ring is inserted under the state that the snap ring has been attached to the tubular part, it is possible, when the edge member is detached form the case band, to detach the snap ring from the tubular part by opening this snap ring while resisting against its elasticity after easily inserting the tip of the tool into the tool inserting small hole.

Further, in a preferred mode of the present invention, the glass is fixed to the annular step part by an adhesive.

In this preferred mode, since the attachment/detachment of the edge member to/from the tubular part of the edge member is performed without giving an excessive strain to the edge member, there is no fear that the glass is exfoliated with the strain of the edge member which is caused when the edge member to/from the case band is attached/detached. Moreover, in addition to the fact that a periphery face of the glass is bonded to an annular periphery face of the annular step part along a thickness direction of the edge member, since a periphery part back face of the glass is bonded to a seat face continuous perpendicularly to the annular periphery face, a bonding area can be largely ensured. For this reason, it is possible to thin a thickness of the edge member while ensuring a necessary bonding area with respect to the glass.

BRIEF DESCRIPTION OF THE DRAWINGS

A preferred form of the present invention is illustrated in the accompanying drawings in which:

FIG. 4 is a perspective view showing one part of an edge member of the wristwatch of FIG. 1 as seen from an outside;

FIG. 5 is a perspective view showing one part of the edge member of the wristwatch of FIG. 1 as seen from an inside;

DETAILED DESCRIPTION OF THE PRESENT INVENTION

A first embodiment of the present invention is explained by referring to FIG. 1 through FIG. 6.

Figure 1:
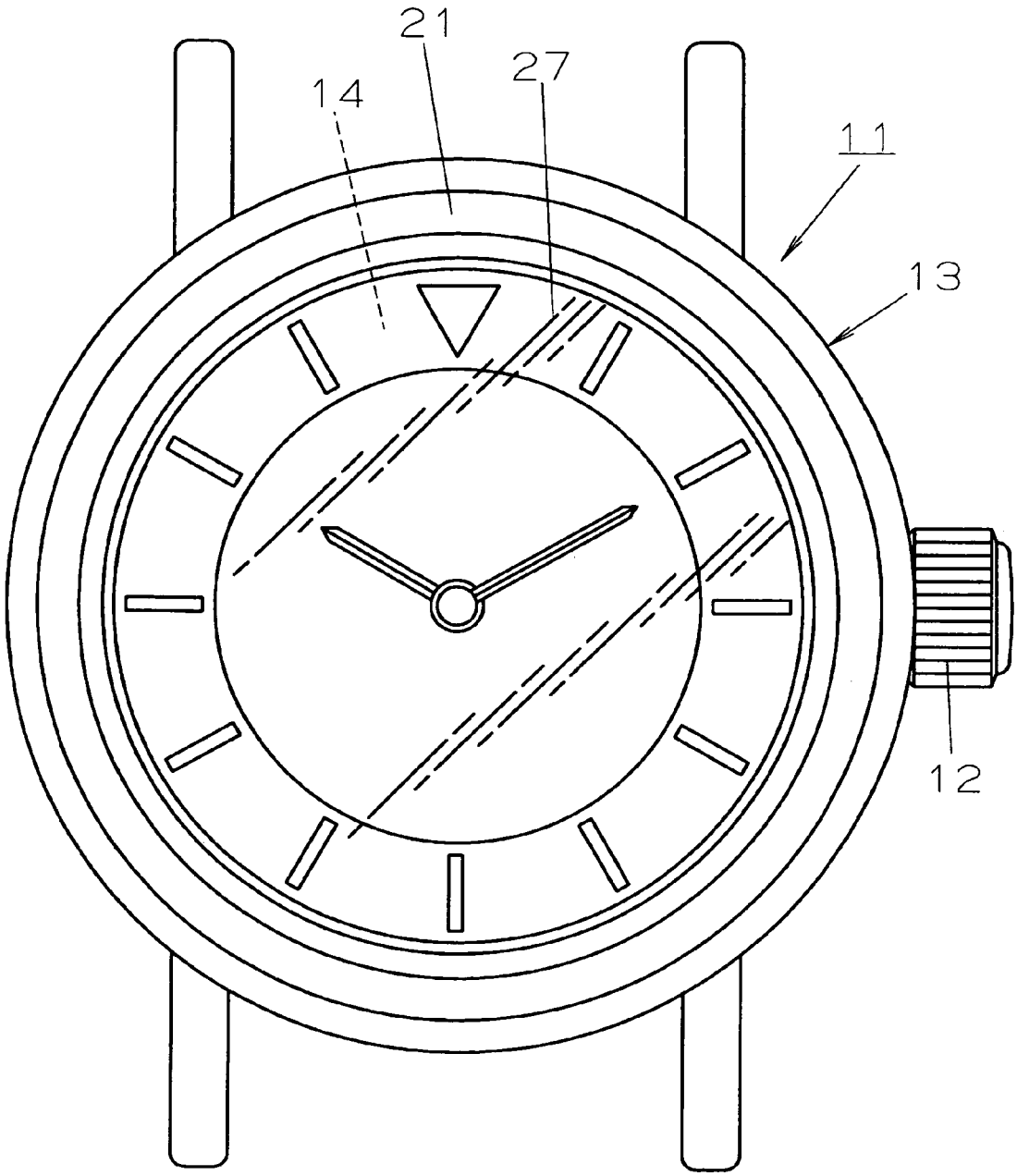
FIG. 1 is a plan view showing a wristwatch according to a first embodiment of the present invention.
Figure 2:
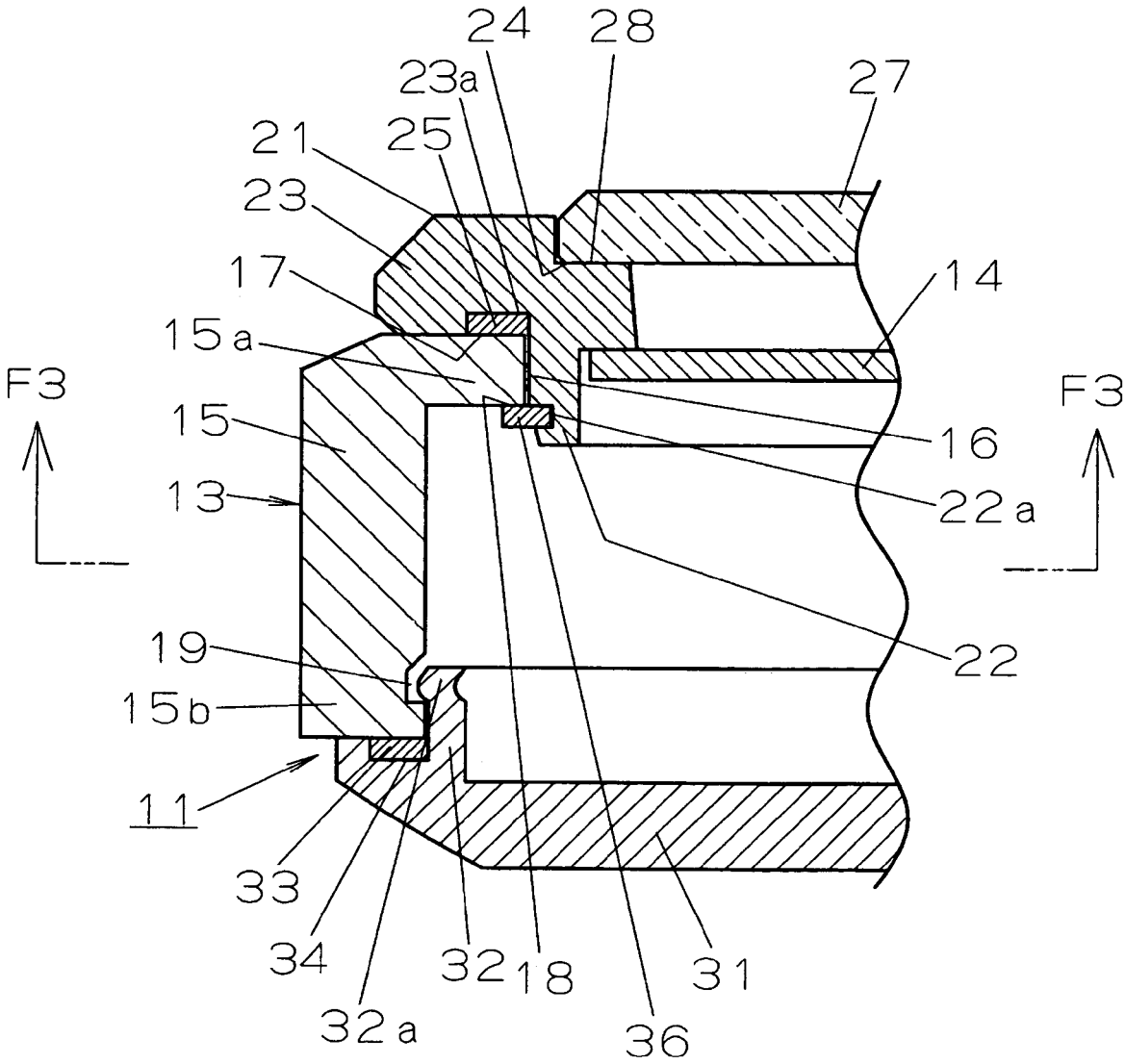
FIG. 2 is a sectional view showing one part of the wristwatch of FIG. 1, while being enlarged.

In FIG. 1, a reference numeral 11 denotes a timepiece, e.g., a portable timepiece capable of screw-locking a crown 12, such as a wristwatch. As shown in FIG. 2, the wristwatch 11 accommodates, in its timepiece armor assembly 13, a dial 14, a timepiece movement (not shown in the drawing), and the like. The timepiece movement may be, for example, one powered by a small battery or a mainspring, or an automatically winding one, or one corresponding to a digital timepiece which digital-displays a time instant and the like on the dial 14 by a quartz oscillation module, or one in which the one corresponding to the digital timepiece and one other than it have been used in combination, or the like.

As shown in FIG. 2, the timepiece armor assembly 13 is formed by mounting a glass 27 to a front side of an annular case band 15 through an edge member 21, and liquid-tightly mounting a case back 31 consisting of a metal or the like to a back side of the case band 15.

The case band 15 consists of a metal such as stainless steel and titanium or a synthetic resin. The case band 15 has a front side end part 15*a*. The front side end part 15*a* protrudes radially inwardly toward an inner hollow part of the case band 15, and a fitting hole 16 is formed in a front side of the case band 15 and constitutes the front opening of the case band.

The fitting hole 16 is circular for instance.

A surface of the front side end part 15*a* forms an edge receiving face 17. This edge receiving face 17 is formed by a plane continuous perpendicularly to the fitting hole 16 so as to extend, e.g., from a front side open end of the fitting hole 16 to its periphery. A back face of the front side end part 15*a* forms an engaging back face 18. This engaging back face 18 is formed by a plane continuous perpendicularly to the fitting hole 16 so as to extend from a back side open end of the fitting hole 16 to its periphery. The edge receiving face 17 and the engaging back face 18 are parallel.

A locking groove 19 is formed in an inner face of a back side end part 15*b* of the case band 15. The case back 31 is detachable with respect to the case band 15 from its back side. For this reason, the case back 31 integrally has an in-case-band insertion tubular part 32 which is elastically deformable, and engaging convex parts 32*a* (only one is shown in the drawing) are formed in several places of a tip part of the in-case-band insertion tubular part 32.

Accordingly, by inserting the in-case-band insertion tubular part 32 into a back side opening of the case band 15, each engaging convex part 32*a* is caught by the engaging groove 19 at the same time as the engaging convex part 32*a* climbs or slides over a lower side edge of the engaging groove 19 while accompanying an elastic deformation of the in-case-band insertion tubular part 32, 80 that it is possible to detachably mount the case back 31 to the case band 15. Under this attached state, it is possible to detach the case back 31 from the case band 15 by inserting a tip part of a tool such as screw driver (not shown in the drawing) into a peripheral part of the case back 31 and the back side end part 15*b* to thereby detach the engaging convex part 32*a* from the engaging groove 19 by wrenching the case back 31. Incidentally, in FIG. 2, a reference numeral 33 denotes an annular packing made of a resinous elastic material. The seal packing 33 is nipped under a compressed state by the case band 15 and the case back 31, bears the waterprooffless/ dustproofness between them, and is fitted and attached, e.g., to a hold groove 34 provided in the case back 31.

The edge member 21 is one used as, e.g., a glass edge holding the glass 27, and is annularly formed by the metal such as stainless steel and titanium or the synthetic resin. As shown in FIG. 2 and FIG. 5, the edge member 21 has integrally a tubular part 22, a cover part 23 and an annular step part 24.

Figure 3:
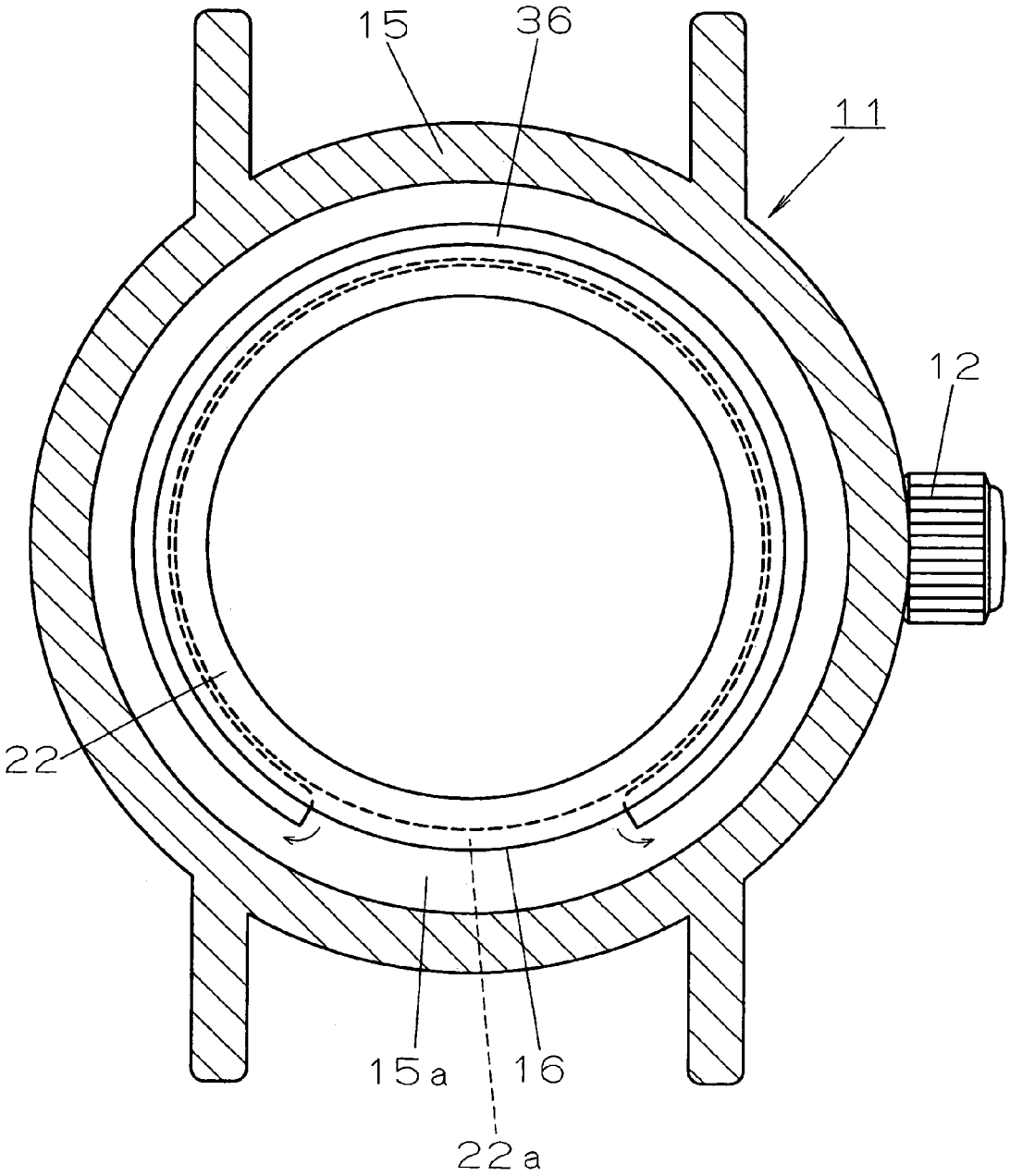
FIG. 3 is a sectional view showing along an arrow line F3-F3 in FIG. 2.

The tubular part 22 is fitted to the fitting hole 16 so as to be capable of being inserted into and disengaged from the same and, as shown in FIG. 3, has a cylindrical shape, for instance. As shown in FIG. 2, a height of the tubular part 22 is longer than a thickness of the front side end part 15*a* of the case band 15. As shown in FIG. 2 and FIG. 4, in a tip part of the tubular part 22, there is formed an annular attaching groove 22*a* which opens to an outer periphery face of the tubular part 22. Additionally, an outer periphery of the tip part extending from the attaching groove 22*a* to a tip face of the tubular part 22 has a taper face 22*b* so that the tip part is tapered. A sectional shape of the attaching groove 22*a* is a quadrangle for instance.

The cover part 23 overlaps the edge receiving face 17 of the front side end part 15*a*. In a back face of this cover part 23, there is formed an annular holding groove 23*a*. To this holding groove 23*a*, an annular seal packing 25 (refer to FIG. 2) made of resinous elastic material is fitted. A thickness of the seal packing 25 under its free state is larger than a depth of the holding groove 23*a*.

As shown in FIG. 5, the annular step part 24 provided in an inner periphery side of the edge member 21 is formed by an annular periphery face 24*a* and a seat face 24*b*. The annular periphery face 24*a* is provided along a thickness direction of the edge member 21, and the seat face 24*b* is formed continuously, perpendicularly to the annular periphery face 24*a*. It is desirable that an area of the seat face 24*b* is larger than an area of the annular periphery face 24*a*. The glass 27 is fitted and fixed to this annular step part 24 through an adhesive 28 (refer to FIG. 2).

The fixation of the glass 27 to the edge member 21 is performed by fitting the glass 27 to the annular step part 24 after the adhesive 28 has been applied to a corner part that the annular periphery face 24*a* and the seat face 24*b* form. By this, the adhesive 28 between the annular step part 24 and a periphery part of the glass 27 is extended along the annular periphery face 24*a* and the seat face 24*b*, the periphery face of the glass 27 contacting with the annular periphery face 24*a* is bonded, and a periphery part back face of the glass 27 contacting with the seat face 24*b* is bonded to the edge member 21.

Figure 6:
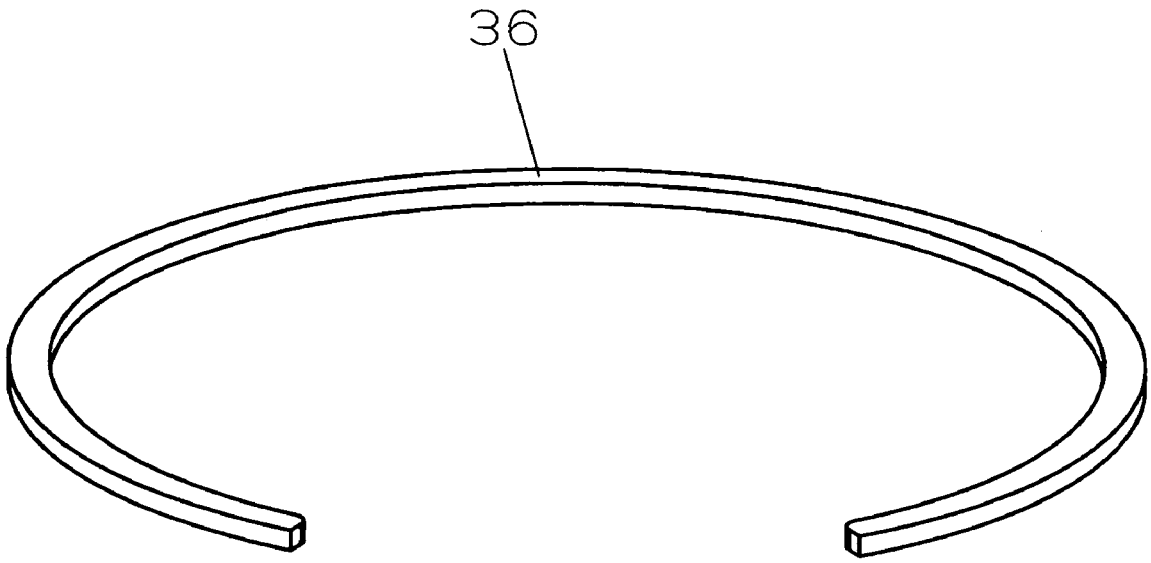
FIG. 6 is a perspective view showing a snap ring of the wristwatch of FIG. 1.

The edge member 21 to which the glass 27 has been mounted is detachably attached to the case band 15 by using a snap ring 36 shown in FIG. 6 and so forth. The snap ring 36 is an open-ended ring formed in a C-shaped form by a metal material whose section is in the shape of a rectangle, and the snap ring 36 is elastically deformable. An inner diameter of the snap ring 36 under its free state is larger than a groove inner diameter along an interior face E (refer to FIG. 5) of the attaching groove 22*a*. An outer diameter of the snap ring 36 is larger than an outer diameter of the tubular part 22 and a diameter of the fitting hole 16 irrespective of whether or not the snap ring 36 is under its free state.

An attachment/detachment of the edge member 21 to/from the case band 15 is implemented as follows under a state that the case back 31 has been detached.

There are explained procedures for attaching the edge member 21, to which the glass 27 and the seal packing 25 have been already incorporated, to the case band 15.

First, the tubular part 22 of the edge member 21 is fitted to the fitting hole 16 of the case band 15 from the front side of the case band 15. Under this state, the back face of the cover part 23 is butted against and seats on the edge receiving face 17 while compressing the seal packing 25 disposed between the edge receiving face 17 of the front side end part 15*a* and the cover part 23 of the edge member 21. Accompanying it, the tip part of the tubular member 22 is inserted into the fitting hole 16, and a wall face F (refer to FIG. 5) remote from the tubular part 22 tip of the attaching groove 22*a* is disposed so as to be continuous and lie in the same plane as the engaging back face 18 of the front side end part 15*a* at approximately the same height as the engaging back face 18.

Next, while this state is being held intact, the snap ring 36 is accommodated in the case band 15 from the back face opening of the case band 15, and this snap ring 36 is pushed to an outer periphery of the tubular part 22 to thereby fit it to the fitting groove 22*a*. In this case, by the taper face 22*b* of a tip site outer periphery of the tubular part 22, since the snap ring 36 is fitted in its inner periphery side site to the attaching groove 22*a* after it is smoothly, elastically deformed in a direction expanding its diameter, the snap ring 36 can be easily attached to the attaching hole 22*a* only by pushing it.

By the attachment of the snap ring 36 in this manner, since an outer periphery of this snap ring 36 is butted against the engaging back face 18 of the front side end part 15*a*, the edge member 21 is mounted to the case band 15 as shown in FIG. 2 with the front side end part 15*a* of the case band 15 being nipped in a thickness direction by the snap ring 36 and the cover part 23 of the edge member 21. By this attachment, the glass 27 faces the dial 14.

Under this state, the snap ring 36 having been fitted to the attaching groove 22*a* maintains its elastic deformation in a direction expanding its diameter, and the butting of the snap ring 36 against the engaging back face 18 is strengthened by an elastic repulsion force of the seal packing 25 under a compressed state. For this reason, since the snap ring 36 maintains its stable state without rattling, an attaching state of the edge member 21, to which the glass 27 has been fixed, to the case band 15 is stabilized as well. Further, since the seal packing 25 between the cover part 23 and the edge receiving face 17 is still nipped under the compressed state, a liquid tightness between the edge member 21 and the case band 15 can be ensured.

Next, procedures for detaching the edge member 21 from the case band 15 will be explained.

By inserting a tool (not shown in the drawing) from the back face opening of the case band 15 under a state that the case back 31 has been detached and catching this tool to an end part of the snap ring 36, this end part is manipulated in such a direction that the snap ring 36 is elastically expanded and opened as shown by an arrow mark in FIG. 3. In this case, it is desirable to open the snap ring 36 gradually while supporting the snap ring 36, which has been already detached from the attaching groove 22*a*, under a state that it has been slantingly intersected to the tip part of the tubular part 22. In this manner, since the snap ring 36 is detached from the tubular part 22 of the edge member 21 and thus the holding of the edge member 21 with respect to the case band 15 is released, it is possible thereafter to detach the edge member 21 by drawing out it from the case band 15.

According to the detachment procedures like this, since it is unnecessary to detach the edge member 21 by wrenching the edge member 21 from the front side of the case band 15, there is no fear that the edge member 21 and the front side end part 15*a* of the case band 15 are damaged.

Since it is possible to attach/detach the edge member 21 to/from the case band 15 as mentioned above, in a case where the edge member 21 and the glass 27 have been impaired, it is possible to exchange the edge member 21 and the glass 27, which are exchange objects, by detaching them from the case band 15 by the already mentioned procedures. Similarly, also in a case where a waterproof/dustproof performance of the seal packing 25 has decreased due to a long period use of the wristwatch 11, after the edge member 21, to which the glass 27 has been fixed, has been reached from the case band 15 by the already mentioned procedures, it is possible to exchange the seal packing 25 which is similarly an exchange object without exchanging the edge member 21, to which the glass 27 has been fixed, and the case band 15. Accordingly, in each of these cases, since it becomes unnecessary to discard at least the case band 15 together with an exchange component, an exchange expense for a repair client can be reduced.

The already-mentioned attachment/detachment of the snap ring 36 to/from the tubular part 22 of the edge member 21 is performed without giving an excessive strain to the edge member 21. By this, there is no fear that, when the edge member 21 is attached/detached to/from the case band 15, the strain of the edge member 21 is exerted on a bonding part of the glass 27 and thus the glass 27 is exfoliated. Since an action exfoliating the bonding does not occur when the edge member 21 is attached/detached, a thickness of the edge member 21 can be thinned. In this manner, it is possible to thin the whole of the wristwatch 11. And, even if the edge member 21 is thinned, in addition to the fact that the periphery face of the glass 27 is bonded to the annular periphery face 24*a* of the annular step part 24 along its thickness direction, since a periphery part back face of the glass 27 is bonded to the seat face 24*b* of the annular step part 24 and a bonding area of the glass 27 with respect to the edge member 21 can be largely ensured, it is possible to certainly fix the glass 27 to the edge member 21.

Incidentally, in a case where the glass 27 is attached to the edge member 21 while an annular elastic packing is nipped between the periphery face of the glass 27 and the annular periphery face 24*a* of the annular step part 24 under its compressed state, the seat face 24*b* of the annular step part 24 cannot be used as a fixing face. For this reason, it is necessary to obtain a necessary glass holding force by increasing a height of the annular periphery face 24*a* and, therefore, it is obliged to thicken the edge member 21 in comparison with the present embodiment.

Figure 7:
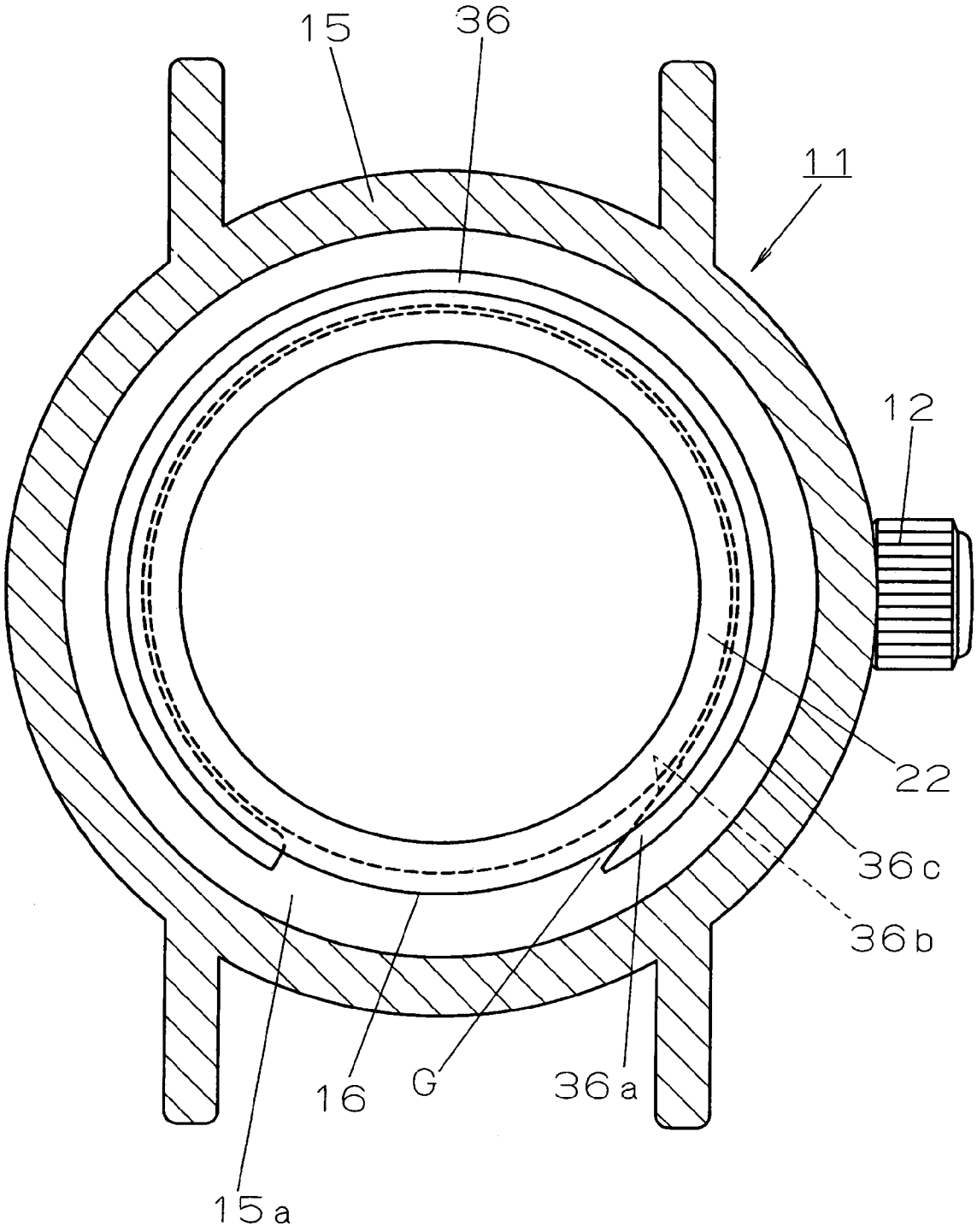
FIG. 7 is a sectional view showing a wristwatch according to a second embodiment of the present invention, which corresponds to FIG. 2.
Figure 8:
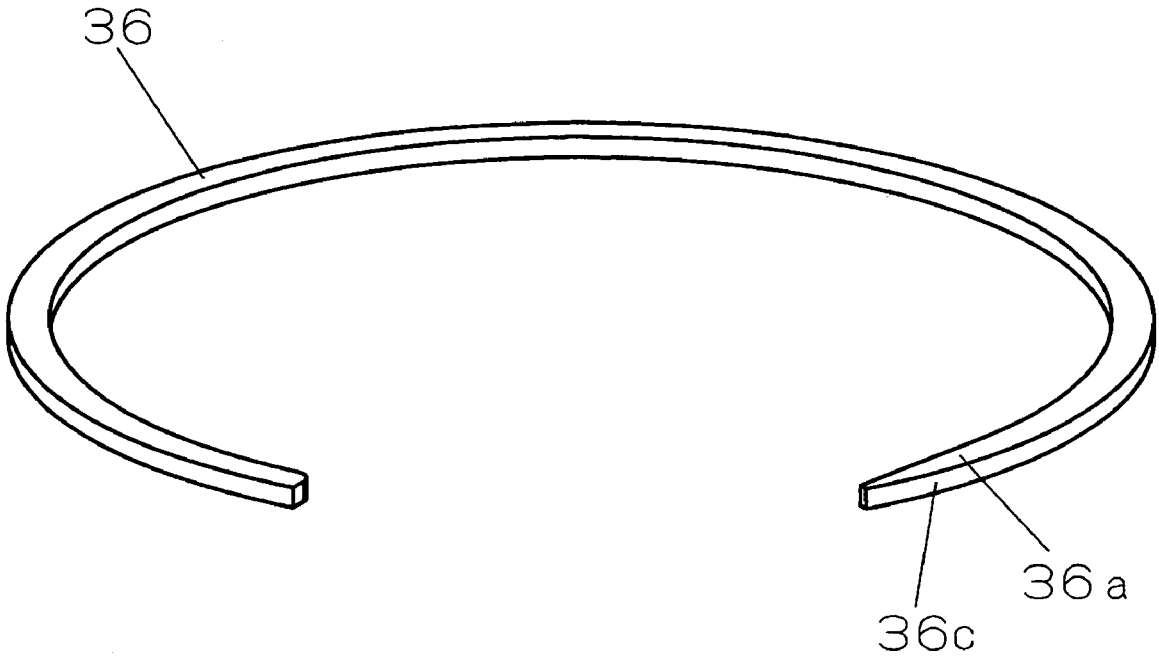
FIG. 8 is a perspective view showing a snap ring of the wristwatch of FIG. 7.

A second embodiment of the present invention is explained by using FIG. 7 and FIG. 8. Since the second embodiment is the same as the first embodiment except matters explained below, the same reference numeral is applied to the same constitution as the first embodiment and its explanation is omitted.

In the second embodiment, an operating part 36*a* is formed in one end part of the snap ring 36. This operating part 36*a* tapers in a direction towards its tip. As shown in FIG. 7, by forming one end part inner periphery face 36*b* of the snap ring 36 with a slant face, this one end part inner periphery face 36*b* gradually approaches the opposite end part outer periphery face 36*c* of the snap ring 36, thereby forming the tapered operating part 36*a*. Under a state that the snap spring 36 has been fitted to the attaching groove 22*a* of the tubular part 22, the operating part 36*a* is disposed while being protruded under a state that, as shown in FIG. 7, the one end part inner periphery face 36*b* slantingly intersects with an outer periphery of the tubular part 22 when it is seen from a case back side. By such a construction, a wedge-like tool inserting gap G is formed between the operating part 36*a* and the tubular part 22.

For this reason, in order to detach the edge member 21 from the case band 15, there can be performed an operation for opening the snap ring 36 by easily inserting a tip of the tool between the tubular part 22 and the snap ring 36. In other words, as already mentioned, since the tool inserting gap G, into which the tool (not shown in the drawing) for detaching the snap ring 36 from the tubular part 22 is inserted, is previously formed, the tip of the tool can be easily inserted into this tool inserting gap G without requiring special labor. By this, thereafter, the snap spring 36 can be easily detached from the tubular part 22 by opening the snap ring 36 while resisting against its elasticity.

Incidentally, the same as the first embodiment can be applied except the matters explained above. Further, in this second embodiment, not only in the one end part of the snap ring 36, but also in the other end part there may be provided the already-mentioned operating part 36*a* which forms the wedge-like tool inserting gap G between it and the tubular part 22.

Figure 9A:
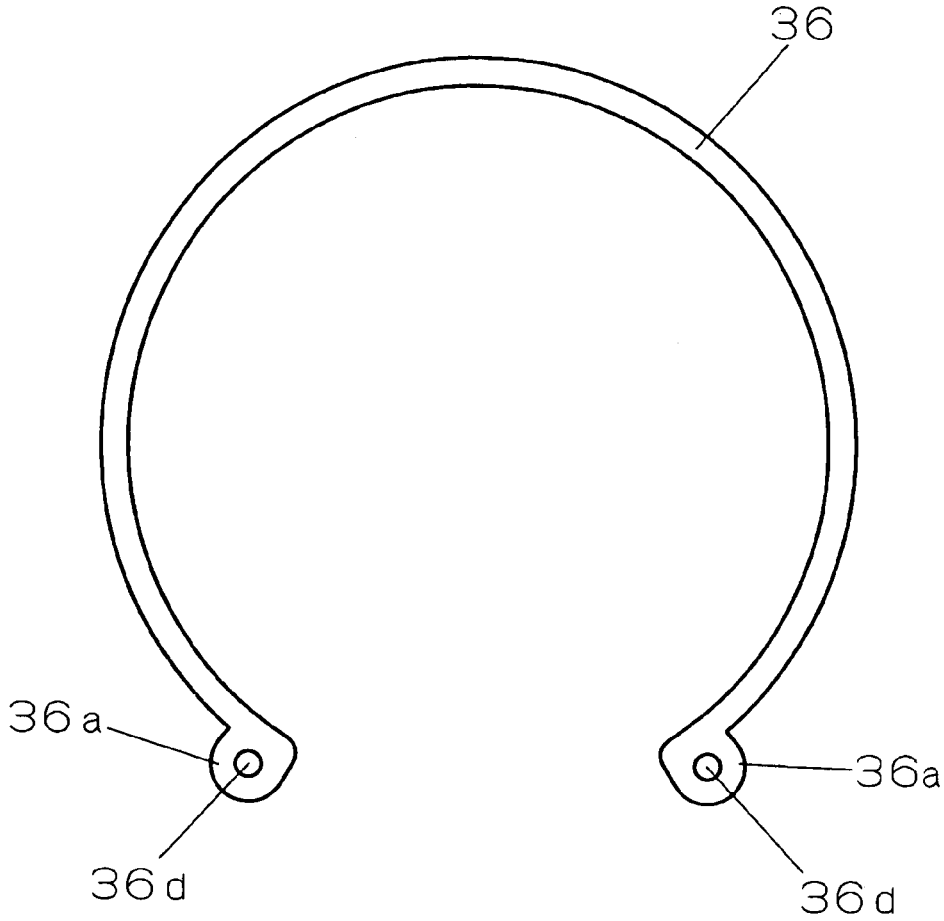
FIG. 9A is a plan view showing a snap ring of a wristwatch according to a third embodiment of the present invention.
Figure 9B:
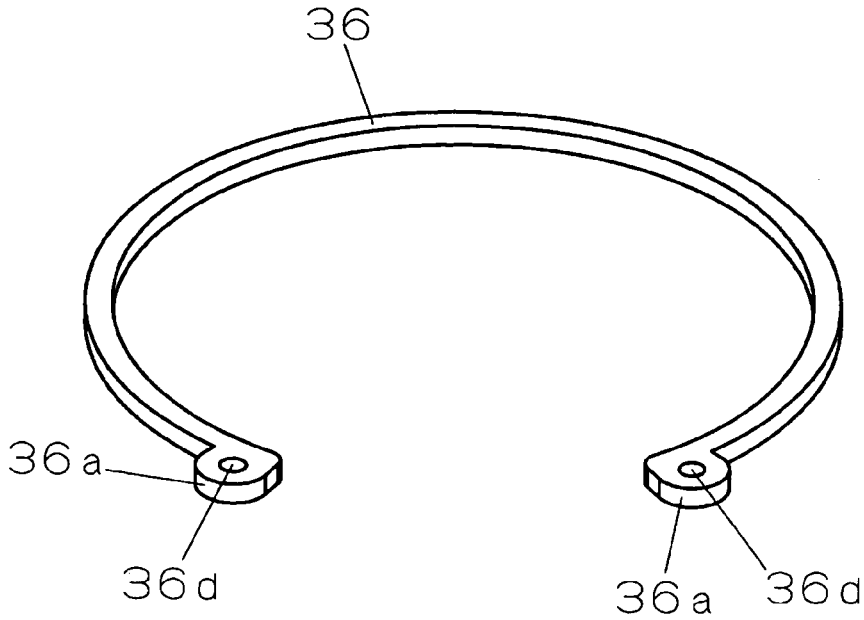
FIG. 9B is a perspective view showing the same snap ring.

A third embodiment of the present invention is explained by using FIG. 9. Since the third embodiment is the same as the first embodiment except matters explained below, the same reference numeral is applied to the same constitution as the first embodiment and its explanation is omitted.

In the third embodiment, at least one end part, preferably both end parts of the snap ring 36, forms the operating part 36*a*, and a tool inserting small hole 36*d* is respectively provided in this operating part 36*a*. Under the state that the snap spring 36 has been fitted to the attaching groove 22*a* of the tubular part 22, this tool inserting small hole 36*d* is disposed while being protruded from the tubular part 22 when it is seen from the case back side. In other words, in the snap ring 36 having been attached to the tubular part 22, the tool inserting small hole 36*d* is provided in a site having been separated from the tubular part 22.

For this reason, in order to detach the edge member 21 from the case band 15, the operation for opening the snap ring 36 can be performed by easily inserting the tip of the tool into the tool inserting small hole 36*d*. Like this, since the tool inserting small hole 36*d*, into which the tool (not shown in the drawing) for detaching the snap ring 36 from the tubular part 22 is inserted, is previously formed, the tip of the tool can be inserted into this tool inserting small hole 36*d* without requiring the especial labor. By this, thereafter, the snap spring 36 can be easily detached from the tubular part 22 by that the snap ring 36 is opened while resisting against its elasticity. Moreover, by operating the snap ring 36 by simultaneously opening its both ends not only its one end, the snap ring 36 can be more easily detached from the tubular part 22. Incidentally, the same can be applied as the first embodiment except the matters explained above.

According to the present invention, it is possible to provide a timepiece in which it has been made possible to exchange the edge member without accompanying the case band in a case where the edge member, to which the glass has been fixed, has been impaired, or the like.

What is claimed is:

1. A timepiece comprising:

an annular case band having a front side end part that forms a fitting hole and that has an edge receiving face around the fitting hole and having an engaging back face that extends continuously around the fitting hole;

a case back detachably attached to a back side end part of the case band;

an annular edge member having a tubular part inserted into and disengageable from the fitting hole and a cover part overlapped with the edge receiving face, the tubular part having an annular attaching groove opening to an outer periphery of the tubular part;

a glass fitted and fixed to an annular step part formed in the edge member; and a snap ring formed of elastically deformable material and having a generally C shape, the snap ring being detachably attached to the attaching groove such that the front side end part is nipped between the snap ring and the cover part with the snap ring abutting the engaging back face, and the snap ring having two opposite end parts, at least one of the end parts being tapered to form a wedge-shaped tool inserting gap between the one end part and the tubular part whereby a tool can be inserted in the gap to elastically deform and detach the snap ring from the attaching groove.

2. A timepiece according to claim 1; wherein the glass is fixed to the annular step part by an adhesive.

3. A timepiece according to claim 1; further including an annular seal packing nipped between the edge receiving face and the cover part under a compressed state.

4. A timepiece comprising:

an annular case band having a front side end part that forms a fitting hole and that has an edge receiving face around the fitting hole and having an engaging back face that extends continuously around the fitting hole;

a case back detachably attached to a back side end part of the case band;

an annular edge member having a tubular part inserted into and disengageable from the fitting hole and a cover part overlapped with the edge receiving face, the tubular part having an annular attaching groove opening to an outer periphery of the tubular part;

a glass fitted and fixed to an annular step part formed in the edge member; and a snap ring formed of elastically deformable material and having a generally C shape, the snap ring being detachably attached to the attaching groove such that the front side end part is nipped between the snap ring and the cover part with the snap ring abutting the engaging back face, and the snap ring having two opposite end parts, at least one of the end parts having a tool inserting hole in which a tool can be inserted to elastically deform and detach the snap ring from the attaching groove.

5. A timepiece according to claim 4; wherein the glass is fixed to the annular step part by an adhesive.

6. A timepiece according to claim 4; further including an annular seal packing nipped between the edge receiving face and the cover part under a compressed state.

7. A timepiece comprising: an annular case band having a front side end part that protrudes radially inwardly toward the inside of the case band and defines a front opening of the case band, and a back side end part; a case back detachably attached to the back side end part of the case band; an annular edge member seated on a front surface of the front side end part and having a tubular part removably inserted into the front opening of the case band, the tubular part having an annular attaching groove that opens to an outer periphery of the tubular part; a glass fixed to the edge member; and an elastically deformable open-ended snap ring detachably attached to the attaching groove in an elastically deformed state, the snap ring abutting a back surface of the front side end part of the case band so that the front side end part is held between the edge member and the snap ring, and the snap ring being detachable from the attaching groove when elastically expanded to enable separation of the edge member and glass from the case band.

8. A timepiece according to claim 7; further including an annular seal packing compressed between the edge member and the front surface of the front side end part of the case band.

9. A timepiece according to claim 7; wherein the edge member and the snap ring overlap one another on the front and back surfaces, respectively, of the front side end part of the case band.

10. A timepiece according to claim 7; wherein the snap ring has one or more operating parts configured to engage with a tool inserted into the case band from the back side thereof after detachment of the case back so that the tool can be used to elastically expand the snap ring to detach same from the attaching groove.

11. A timepiece according to claim 10; wherein the open-ended snap ring has two spaced-apart opposite end parts, at least one of the end parts being provided with one operating part.

12. A timepiece according to claim 7; wherein the open-ended snap ring has two spaced-apart opposite end parts, at least one of the end parts being tapered to form a wedge-shaped gap between the one end part and the tubular part so that a tool can be inserted into the gap from the back side of the case band after detachment of the case back to elastically expand and detach the snap ring from the attaching groove.

13. A timepiece according to claim 7; wherein the open-ended snap ring has two spaced-apart opposite end parts, at least one of the end parts having a tool inserting hole in which a tool can be inserted from the back side of the case band after detachment of the case back to elastically expand and detach the snap ring from the attaching groove.

14. A timepiece according to claim 7; wherein the front and back surfaces of the front side end part are parallel to one another.

15. A timepiece according to claim 7; wherein the front surface of the front side end part on which is seated the edge member and the back surface of the front side end part on which abuts the snap ring are parallel to one another.

16. A timepiece according to claim 15; wherein the edge member and the snap ring overlap one another on the front and back surfaces, respectively, of the front side end part of the case band.

17. A timepiece according to claim 15; wherein the snap ring has one or more operating parts configured to engage with a tool inserted into the case band from the back side thereof after detachment of the case back so that the tool can be used to elastically expand the snap ring to detach same from the attaching groove.

* * * * *